US006505571B1

(12) United States Patent
Critchfield et al.

(10) Patent No.: US 6,505,571 B1
(45) Date of Patent: Jan. 14, 2003

(54) HYBRID HULL CONSTRUCTION FOR MARINE VESSELS

(75) Inventors: Milton O. Critchfield, Great Falls, VA (US); Chin-Tun Kuo, Rockville, MD (US); Loc B. Nguyen, Sterling, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/982,388

(22) Filed: Oct. 17, 2001

(51) Int. Cl.[7] ..... B63B 3/00
(52) U.S. Cl. ..... 114/65 R; 114/357
(58) Field of Search ..... 114/65 R, 355, 114/356, 88, 357

(56) References Cited

U.S. PATENT DOCUMENTS

| | | | | |
|---|---|---|---|---|
| 3,002,591 A | * | 10/1961 | Hess | 114/88 |
| 3,610,196 A | | 10/1971 | Lowry | |
| 3,822,427 A | | 7/1974 | Ewart, Jr. | |
| 3,878,806 A | | 4/1975 | Garcia | |
| 3,938,459 A | | 2/1976 | Wilbanks et al. | |
| 3,965,513 A | | 6/1976 | Horiuchi | |
| 4,113,910 A | | 9/1978 | Loyd | |
| 4,269,375 A | | 5/1981 | Hickey | |
| 4,344,995 A | | 8/1982 | Hammer | |
| 4,542,056 A | | 9/1985 | Anglin et al. | |
| 4,599,255 A | | 7/1986 | Anglin et al. | |
| 4,662,587 A | | 5/1987 | Whitener | |
| 4,936,238 A | | 6/1990 | Childress | |
| 5,090,346 A | | 2/1992 | Goldman | |
| 5,199,368 A | | 4/1993 | Souda | |
| 5,347,944 A | | 9/1994 | Dupre et al. | |
| 5,778,813 A | * | 7/1998 | Kennedy | 114/69 |
| 6,058,864 A | | 5/2000 | Mannerfelt | |
| 6,114,050 A | | 9/2000 | Westre et al. | |
| 6,386,131 B1 | * | 5/2002 | Barsoum | 114/357 |

* cited by examiner

*Primary Examiner*—Stephen Avila
(74) *Attorney, Agent, or Firm*—Jacob Shuster

(57) ABSTRACT

The metallic midship section of a hybrid marine vessel hull is attached through transition extensions thereof to bow and stem sections of the hull made of a fiber reinforced plastic having transition extensions of reduced cross-section abutting and/or overlapping the transition extensions of the metallic hull section and held firmly attached thereto by holding attachments carried by cover plating extending between the overlapped transition extensions.

24 Claims, 7 Drawing Sheets

FIG. 11
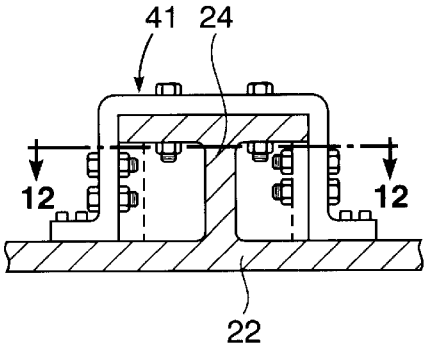
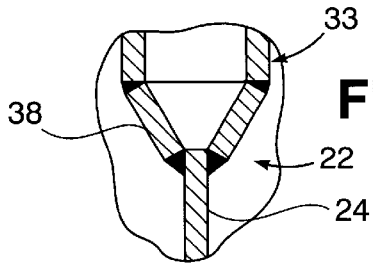
FIG. 12
FIG. 13
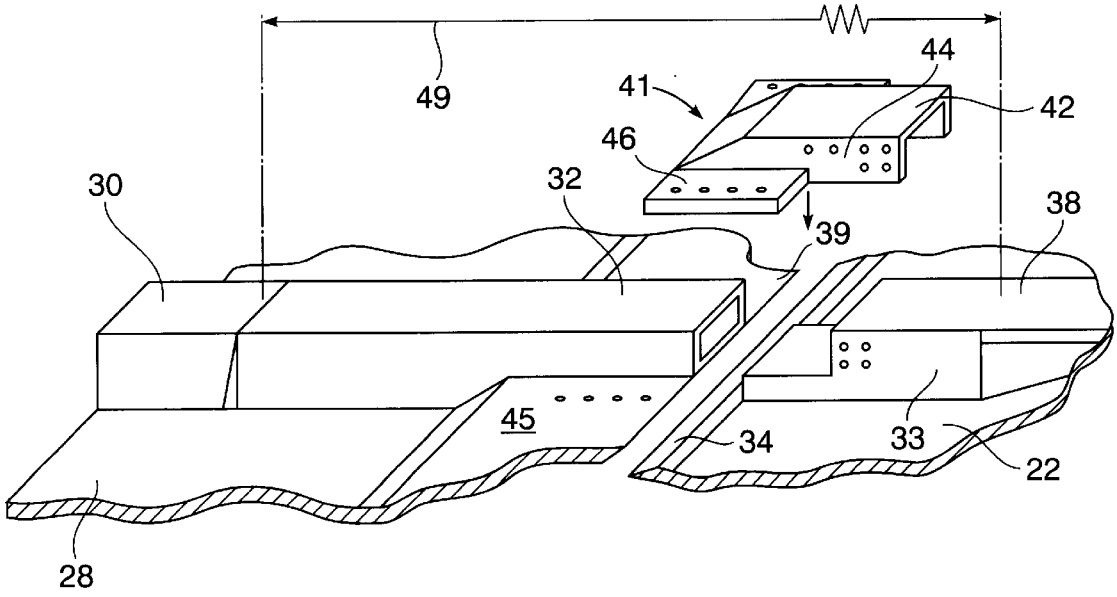
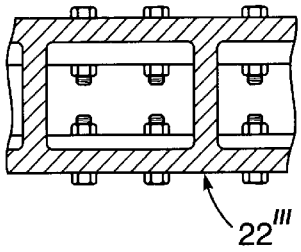
FIG. 14

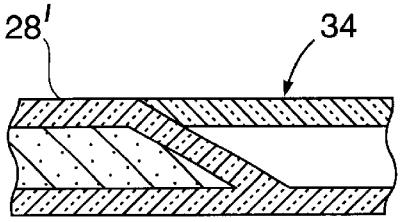
FIG. 18
FIG. 19
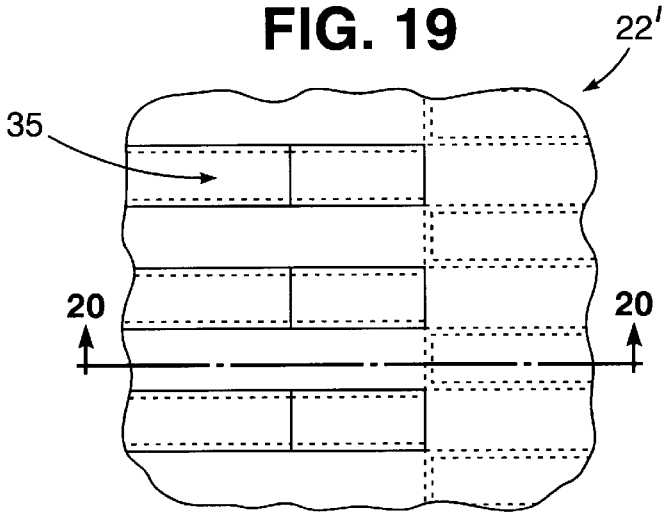
FIG. 20
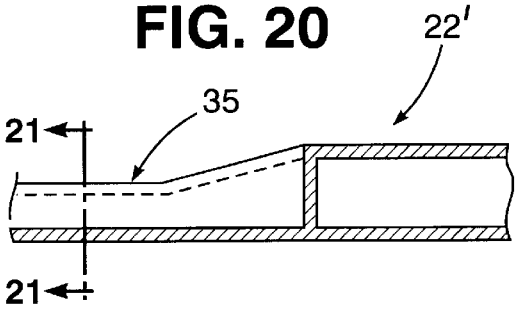
FIG. 21
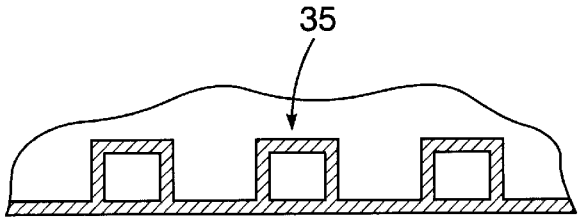

HYBRID HULL CONSTRUCTION FOR MARINE VESSELS

The present invention relates generally to the construction of marine vessel hulls.

BACKGROUND OF THE INVENTION

The hulls of marine vessels have traditionally been constructed of wood, steel or fiber-reinforced plastic materials. Various conventional constructional arrangements are available for vessel hulls, such as longitudinally stiffened, double hull or sandwich configurations. Such hulls are usually constructed of a single one of the materials. The midbody of the vessel hull may be economically constructed using a metallic material, while the more geometrically complex bow and stern may be more economically constructed using different non-metallic materials which are now preferred for the support of signature and propulsion system requirements associated with the bow and stem of the vessel. It is therefore an important object of the present invention to provide for the construction of a hull for various marine vessels including naval and commercial ships, which will not only minimize fabrication costs but will at the same time accommodate various requirements such as those providing reduced radar and magnetic signatures and absorption of noise generated by propulsion machinery on naval ships.

SUMMARY OF THE INVENTION

In accordance with the present invention, conventional economic construction of the marine vessel midbody is utilized by its fabrication from a metallic material such as magnetic or non-magnetic steel or titanium, either with longitudinal stiffening by ribs or a double hull arrangement. Both arrangements may involve some transverse framing. A more complex structure is however associated with the bow and stern of the marine vessel to meet signature and propulsion requirement conditions, by use of fiber reinforced plastic materials that are either longitudinally stiffened or of sandwich construction, both of which may involve some transverse framing. In order to render such differently constructed midship, bow and stem sections geometrically compatible, they are provided with transition extensions that overlap and are attached to each other by special joints to complete a hybrid hull assembly. The special attachment joints are provided so as to accommodate different embodiments, wherein flat and curved abutting and overlapping hull shell and stiffener extensions of the midbody and bow or stern sections are attached and joined by holding means such as bolts and/or adhesive. Side tapered metallic holding collars are utilized in certain embodiments for facilitated joining of stiffeners, with plating associated therewith to attach the overlapping transition extensions of the shell sections of the hull. In other embodiments, separate plating may be utilized for firm interconnections of the abutting or overlapping transition extensions of the hull shell sections by holding means such as the bolts and/or adhesive.

BRIEF DESCRIPTION OF DRAWING

A more complete appreciation of the invention and many of its attendant advantages will be readily appreciated as the same becomes better understood by reference to the following detailed description when considered in connection with the accompanying drawing wherein:

FIG. 11 is a partial section view taken substantially through a plane indicated by section 11—11 in FIG. 8;

FIG. 12 is a partial section view taken substantially through a plane indicated by section line 12—12 in FIG. 11;

FIG. 13 is a perspective view of the parts forming a transition between hull sections as shown in FIGS. 7–12, in a disassembled condition;

FIG. 14 is a partial transverse section view taken substantially through a plane indicated by section line 14—14 in FIG. 8A;

FIG. 18 is a partial section view taken substantially through a plane indicated by section line 18—18 in FIG. 15;

FIG. 19 is a partial top plan view showing transition from the midbody construction shown in FIG. 6;

FIG. 20 is a partial section view taken substantially through a plane indicated by section line 20—20 in FIG. 19; and FIG. 21 is a partial section view taken through a plane indicated by section line 21—21 in FIG. 20.

DETAILED DESCRIPTION OF PREFERRED EMBODIMENTS

Figure 1:
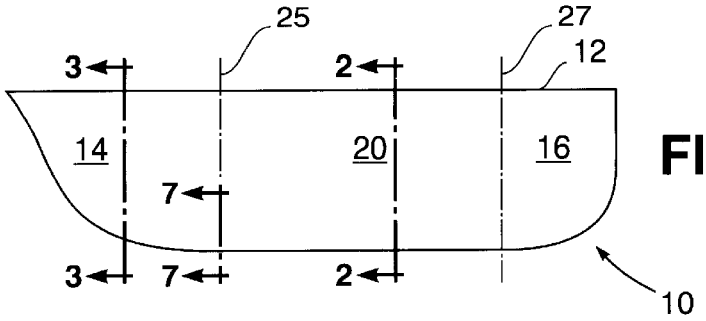
FIG. 1 is a simplified side elevation view of a marine vessel hull constructed in accordance with the present invention.

The drawing in FIG. 1 schematically illustrates a marine vessel hull 10 of hybrid construction, having a top deck 12 extending between a bow section 14 and a stem section 16 on opposite sides of its midbody section 20. Such hull sections 14, 16 and 20 are attached to each other at locations 25 and 27 as diagrammed in FIG. 1.

Figure 2:
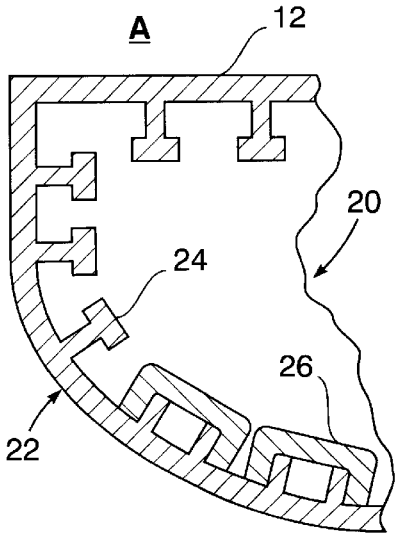
FIGS. 2 and 3 are partial transverse section views taken substantially through planes indicated by section lines 2—2 and 3—3 in FIG. 1, showing one embodiment of the present invention.
Figure 2A:
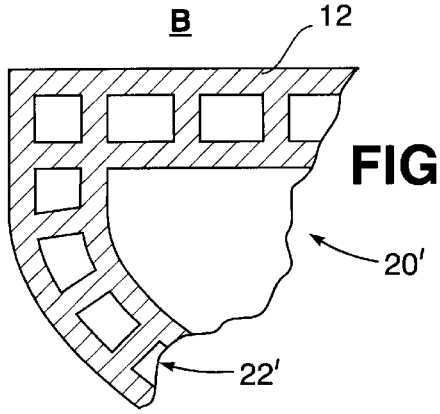
FIG. 2A is a partial section view similar to FIG. 2 showing another embodiment.

As shown in FIG. 2, the shell 22 of the hull 10 along the midbody section 20 is structured from a metal having longitudinally stiffening ribs 24 and a bottom having a formation 26. As an alternative thereto, FIG. 2A shows a midbody section 20' having a metallic sandwich or advanced double hull construction 22'. As to the associated bow or stern sections of the advanced double hull midbody construction 22' or the longitudinally stiffened midbody construction 22, they are structured differently from than that of the shell 22 or the shell 22' of the midbody sections 20 and 20'.

Figure 3:
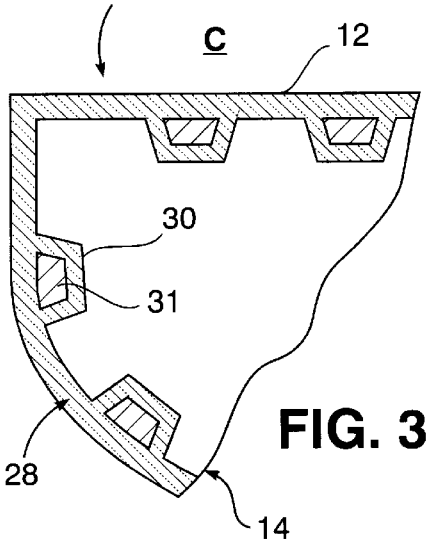

As shown in FIG. 3, the shell 28 of the bow section 14 is made of a fiber-reinforced plastic material and is stiffened by longitudinally extending hat-shaped ribs 30 having low density, non-structural cores 31 therein, such as balsawood or closed-cell foam. The same fiber-reinforced plastic shell construction is utilized for the stem hull section 16. As an alternative, the bow or stem hull section may have a shell 28' of a fiber reinforced sandwich construction as shown in FIG. 3A.

It will be apparent from the foregoing, that there are four different shell sections 22, 22', 28 and 28', respectively illustrated in FIGS. 2, 2A, 3 and 3A, from which different hybrid concepts are derived for construction of a hybrid hull pursuant to the present invention. Such hybrid concepts require different transitions between the hull sections as outlined in the following table.

Figure 3A:
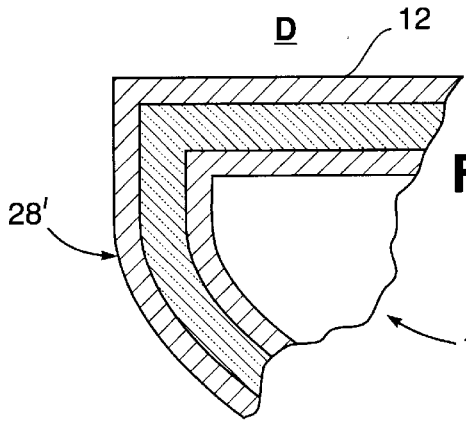
FIG. 3A is a partial section view similar to FIG. 3 showing another embodiment.

| MID-BODY SECTION 20 | BOW OR STERN SECTIONS 14 & 16 | HYBRID CONCEPT | TRANSITION CONCEPT | ATTACHMENT METHOD |
|---|---|---|---|---|
| FIG. 2 | FIG. 3 | A–C | T1 | 1 OR 2 |
| FIG. 2 | FIG. 3A | A–D | T1 & T2 | 1 OR 2 |
| FIG. 2A | FIG. 3A | B–D | T2 & T3 | 1, 2 OR 3 |
| FIG. 2A | FIG. 3 | B–C | T3 | 1 OR 2 |

Figure 4:
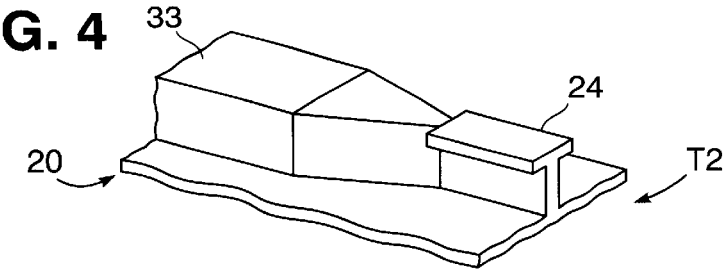
FIGS. 4, 5 and 6 are partial perspective views showing different transition arrangements between hull sections shown in FIGS. 1–3, 2A and 3A.

According to the hybrid concept A–C listed in the foregoing table, the metallic T-stiffened structure 24 of the midbody section 20 is transitioned to a metallic hat-stiffened structure 33, using transition concept T1 as shown in FIG. 4. The extended metallic hat stiffeners 33 in the midbody are then geometrically compatible with the FRP hat-stiffeners 30 in the bow or stem sections as shown in FIG. 3, and are joined along with the associated hull plating using attachment methods 1 or 2 as hereinafter described, to form the hybrid concept A–C.

Figure 5:
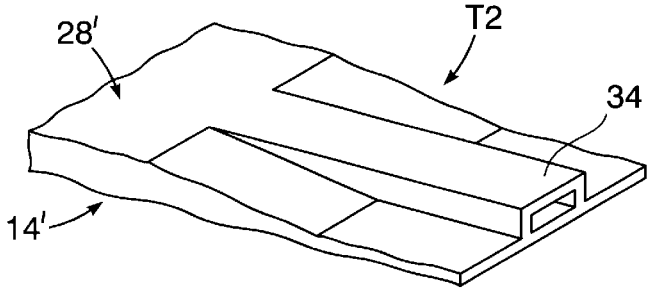

In hybrid concept A–D, the metallic T-stiffened structure 24 of the midbody section 20 is transitioned to a metallic hat-stiffened structure 33 using transition concept T1 as shown in FIG. 4, while the FRP sandwich structure 28' of the bow 14' or stem of FIG. 3A is transitioned to a hat-stiffened configuration 34 using transition concept T2 as shown in FIG. 5. The extended metallic hat stiffeners 33 in the midbody are then geometrically compatible with the extended FRP hat stiffeners 34 in the bow or stem sections, and are joined along with the associated hull plating, using attachment methods 1 or 2 as hereinafter described, to form the hybrid concept A–D.

Figure 6:
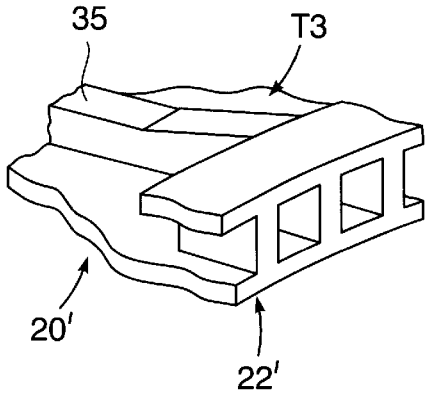
Figure 7:
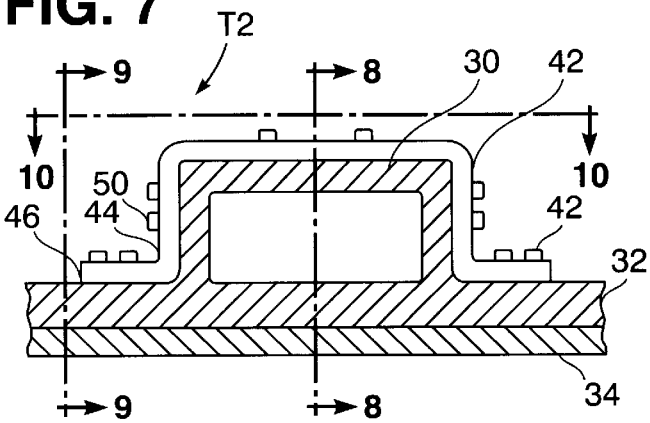
FIG. 7 is an enlarged partial section view taken substantially through a plane indicated by section line 7—7 in FIG. 1.

In the hybrid concept B–D, the metallic double hull sandwich structure of the midbody shell 22' is transitioned to a metallic hat-stiffened structure 35 using the transition concept T3 as shown in FIG. 6, while the FRP sandwich structure 28' of the bow 14' or stem is transitioned to the hat-stiffened configuration 34 using transition concept T2 as shown in FIG. 5. The extended metallic hat-stiffeners 35 in the midbody section are then geometrically compatible with the extended FRP hat stiffeners 34 in the bow or stem and may be joined, along with the associated hull plating using attachment methods 1 or 2. Alternatively, since the metallic midbody double hull sandwich structure of FIG. 2A and the FRP bow or stem sandwich structure of FIG. 3A are geometrically compatible, they may be directly joined, using attachment method 3 as hereinafter described.

In hybrid concept B–C, the metallic double hull structure of the midbody shell 22' is transitioned to a metallic hat-stiffened structure 35 using the transition concept T3, as shown in FIG. 6. The extended metallic hat-stiffeners in the midbody section 20' are then geometrically compatible with the extended FRP hat stiffeners 30 in the bow 14 or stem and are again joined, along with the associated hull plating using attachment methods 1 or 2 as hereinafter described to form the hybrid concept B–C.

Figure 8:
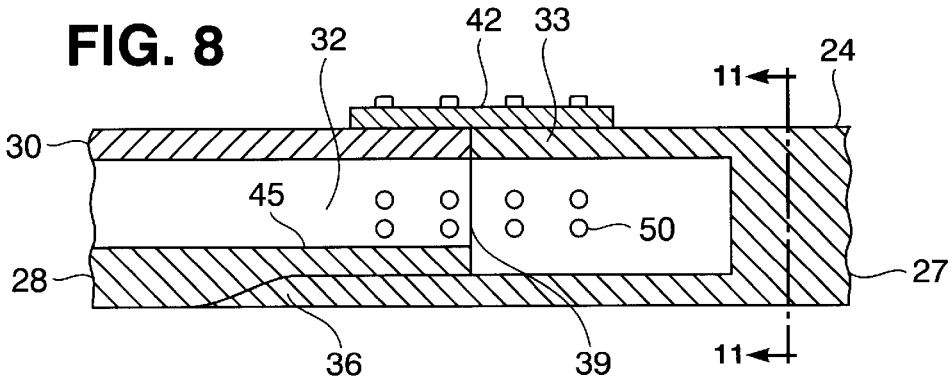
FIGS. 8, 9 and 10 are partial section views taken substantially through planes indicated by section lines 8—8, 9—9 and 10—10 in FIG. 7.

Use of attachment method 1 for implementing the joint between the bow section 14 and the midship section 20 under hybrid concept A–C, is illustrated in FIGS. 7–13. The laterally spaced hat stiffening ribs 30 of the bow shell 28 as shown in FIG. 3 extend along its transition location into interfitting abutment with hat stiffening transition extensions of the ribs 24 on the midship section shell 22 of the hull 10 as shown in FIG. 2. As shown in FIG. 12, the transition between the ribs 24 and the hat stiffening ribs 33 are formed by pairs of diverging connector elements 38 welded to the webs of corresponding rib extensions 24. As shown in FIG. 8, each bow transition extension of a corresponding bow shell rib 30 may be of varying cross-section, including a reduced cross-sectional extension 32 overlapping an extension 36 of the midship hull shell 22 which has a hat stiffened portion 33 of a stiffening rib extension 24 terminating in abutment with end 39 of the bow rib extension 32. Each of such hat stiffened portions 33 extends from a transition portion 38 of one of the T-shaped cross-sectional midship shell ribs 24 as shown in FIG. 12 and FIG. 13. The transition shell extension 36 extends from the midship shell 22 in underlying relation to an extension 45 of the bow shell 28 to establish a flush transition surface relationship between the undersurfaces of the hull section shells 22 and 28 as shown in FIG. 8.

Figure 9:
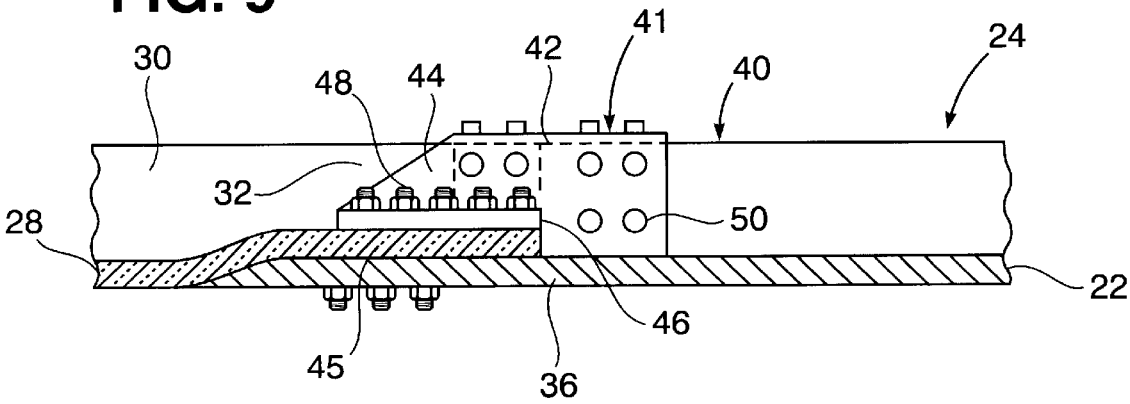

As also shown in FIGS. 7–11, the overlapping transition extensions 45 and 36 of the bow shell 28 and the midship section shell 22 respectively, are held attached by an attachment joint generally referred by reference numeral 41. Each attachment joint 41 has a collar 42 bridging the abutting transition stiffening portions with tapered sides 44 extending longitudinally therefrom alongside the bow rib transition extension 32. Plates 46 also extend laterally from such collar sides 44 for attachment by bolts 48 to underlying surfaces of the overlapping bow shell extension 45 and midship shell extension 36, while bolts 50 firmly attach the collar sides 44 and flange to the abutting stiffening transition extensions of the bow and midship hull shell structures as shown in FIG. 9. Such attachment involves bolting between parts and could include the use of welding and adhesive bonding.

FIG. 13 shows various parts of the bow and midship shell structures along a transition length 49 in close disassembled relation to each other with their transition forming portions underlying disconnected attachment collar 42 of the joint 41.

Figure 9A:
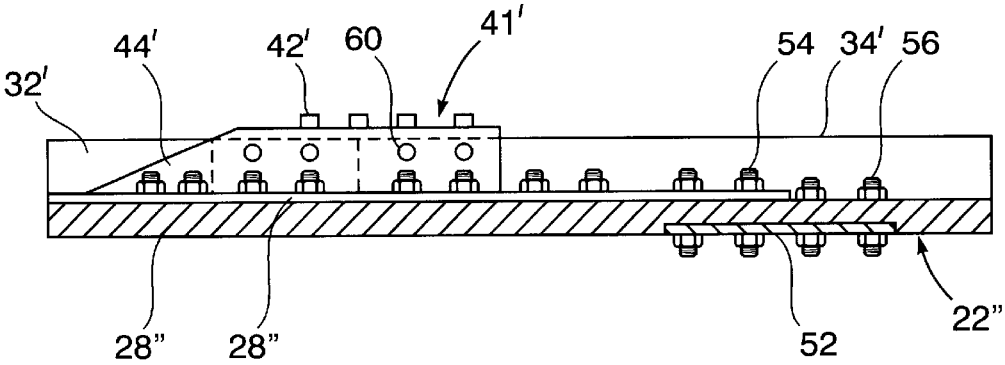
FIGS. 9A and 10A are partial views respectively corresponding to FIGS. 9 and 10, but showing another embodiment of the present invention.
Figure 10:
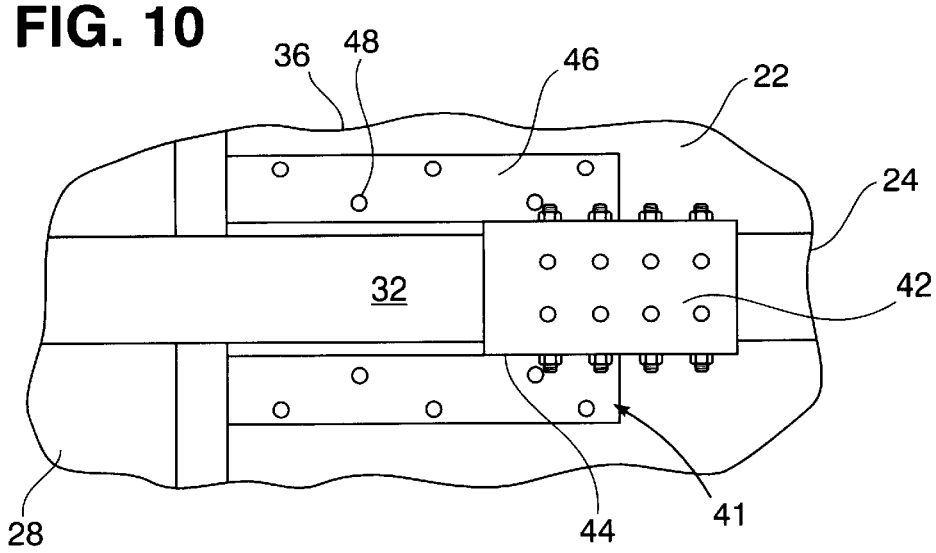
Figure 10A:
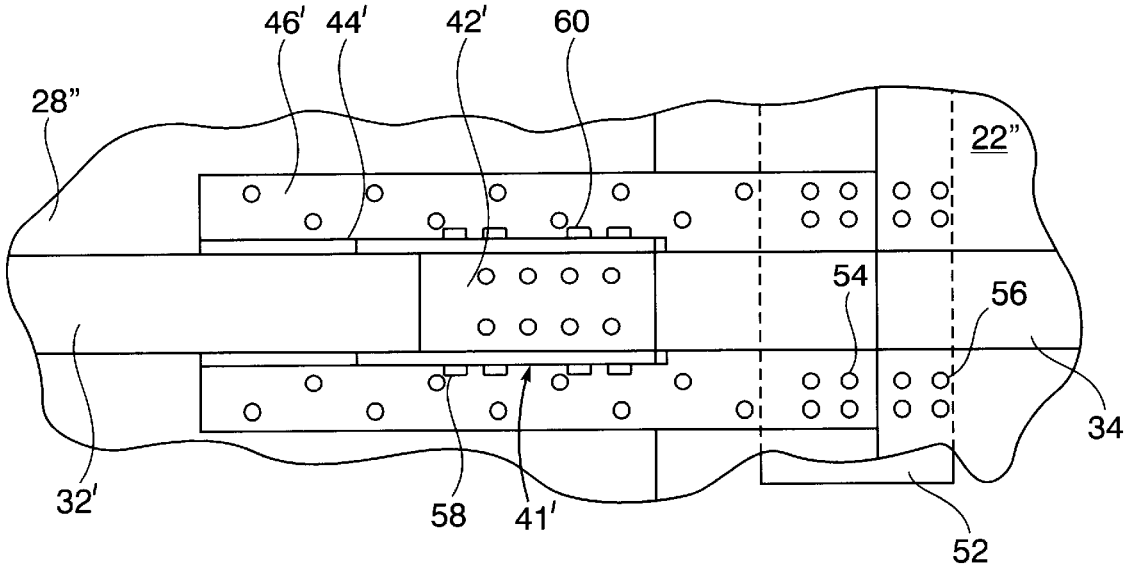
Figure 15:
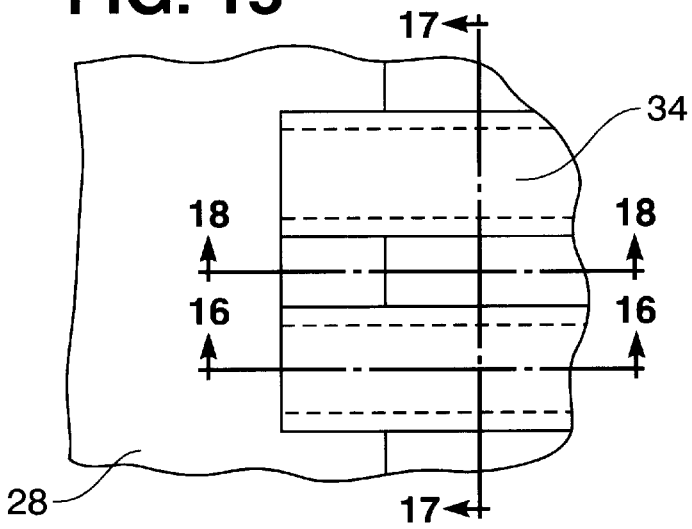
FIG. 15 is a partial top plan view showing transition from the bow construction shown in FIG. 5.
Figure 16:
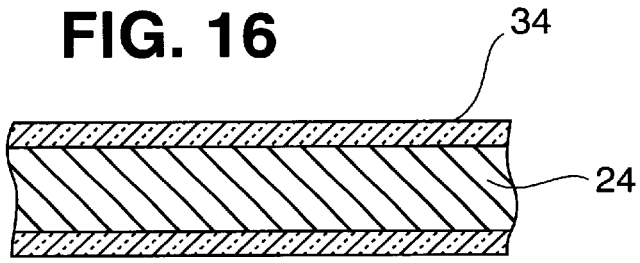
FIG. 16 is a partial section view taken substantially through a plane indicated by section line 16—16 in FIG. 15.
Figure 17:
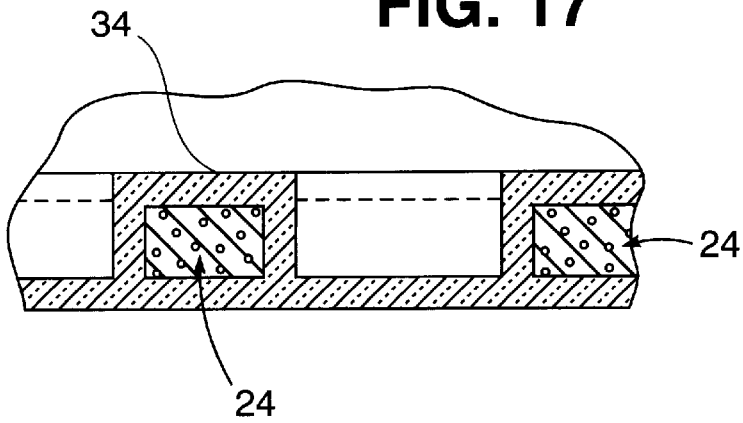
FIG. 17 is a partial section view taken substantially through a plane indicated by section line 17—17 in FIG. 15.

Use of the joint attachment method 2 is shown in FIGS. 9A and 10A, for holding a hat stiffened bow or stem hull shell structure 28" attached to a midship hull shell structure 22", wherein such shell structures 28" and 22" correspond to the hull shell structures 28 and 22 hereinbefore described in connection with FIGS. 1–13. A metallic connecting plate 52 extends in underlying relation between the shell transition extensions 32' and 34' and is attached thereto by holding means such as bolts 54 and 56 and/or welding and adhesive. The attachment joint 41' has a collar 42' with sides 44' from which side plates 46' extend laterally. Such collar sides 44' and side plates 46' are firmly attached by bolts 58 to the transition rib 32' while bolts 60 attach the collar sides 44' and side plates 46' to the other transition rib 34' in abutment therewith within the collar 42'.

Figure 8A:
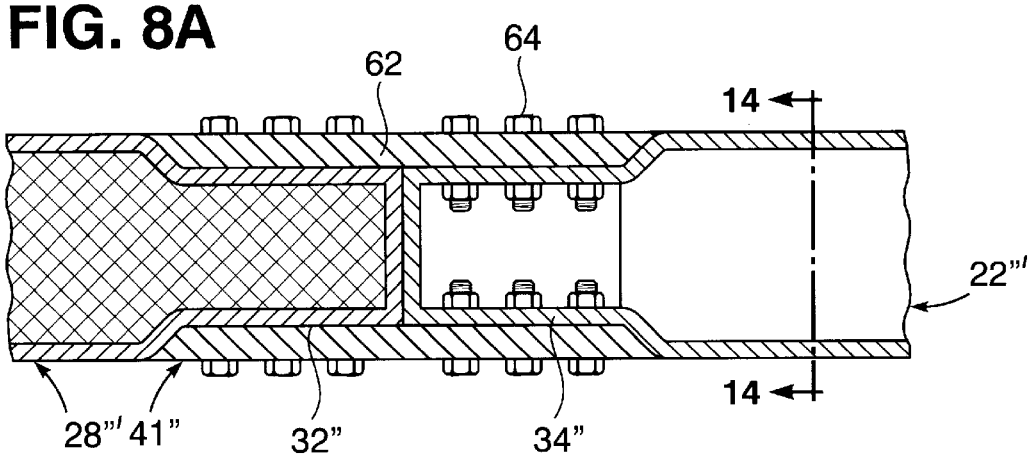
FIG. 8A is a partial section view corresponding to FIG. 8, but showing yet another embodiment of the present invention.

The use of attachment method 3 is illustrated in FIGS. 8A and 14 for attaching a FRP sandwich type bow or stem directly to a metallic double hull type midbody to form concept B–D. Midship and bow section sandwich shells 22'" and 28'" respectively have reduced cross-sectional transition extensions 34" and 32" which abut between rectangular attachment plates 62 of ajoint 41", as shown in FIG. 8A. Such joint 41" interconnects the shell extensions 32" and 34" by means of fastener bolts 64 and/or welding and adhesives.

Further embodiments of the present invention involve hybrid concept A–D for a hull having a metallic midship section of reinforced shell construction 22 as shown in FIG. 2 and plastic bow and stem sections of fiber reinforced sandwich construction 28' as shown in FIG. 3A. The bow section sandwich construction 28' is provided in this embodiment with cross-sectionally hat-shaped transition extensions 34 as shown in FIGS. 5 and 15–18, abutting hat-shaped transition extensions 33 of the ribs 24 on the midship section shell 22 as shown in FIGS. 4 and 12. Such abutting transition extensions may be attached by joints 41 as shown in FIGS. 7–10 or by joints 41' as shown in FIGS. 9A and 10A.

Still further embodiments of the present invention involve a hybrid hull B–C having a metallic double hull sandwich type midship section shell 22' as shown in FIG. 2A and a plastic section type shell 28 for the bow and stem of a hat-shaped stiffened construction as shown in FIG. 3. Hull section shell 22' is provided with a transition involving hat-shaped transition extensions 35 as shown in FIGS. 6, 19, 20 and 21 to achieve geometric compatibility with the hat-stiffened extensions 32, shown in FIGS. 7 and 8, of the ribs 30 associated with the bow section 14 shown in FIG. 3. The abutting transition extensions 35 and 32 are attached to each other by joints 41 as shown in FIGS. 7–10 or by joints 41' as shown in FIGS. 9A and 10A.

The present invention thus covers hybrid hulls which include different low mass construction embodiments of reinforced fiber plastic hull sections for the bow and stern, such as the hull sections 28, and 28' as hereinbefore described, attached to a midship hull section 20 of a metallic steel structure, such as the midship hull shells 22 and 22' as hereinbefore described. Attachment of such bow and stem sections of the same construction to a midship shell section of a different construction is effected through a joint 41, 41' or 41".

Obviously, other modifications and variations of the present invention may be possible in light of the foregoing teachings. It is therefore to be understood that within the scope of the appended claims the invention may be practiced otherwise than as specifically described.

What is claimed is:

1. In combination with a hybrid hull of a marine vessel including a midship hull section with bow and hull stern sections extending in opposite direction from and structured differently from the midship hull section; transition means including extensions from the differently structured hull sections for establishment of geometric compatibility therebetween; and an arrangement for interconnection of the differently structured hull sections, comprising: plate means for retaining the differently structured hull sections in abutment with each other through the extensions during said establishment of the geometric compatability; and holding means carried by said plate means for attaching the differently structured hull sections to each other by attachment insertions from the plate means through said extensions so as to avoid adversely affecting said establishment of the geometric compatability by the transition means with the extensions held in said abutment by the attachment insertions of the holding means.

2. The hybrid hull as defined in claim 1, wherein said establishment of the geometric compatability by the transition means establishes a flush cross-sectional relation between the differently structured hull sections by overlapping contact between the extensions.

3. The hybrid hull as defined in claim 2, wherein said midship section is made of reinforced metal and the bow and stem sections are made of reinforced non-metallic material.

4. The hybrid hull as defined in claim 3, wherein said plate means includes inserts interfitted between the extensions and secured thereto by said insertions of the holding means.

5. The hybrid hull as defined in claim 4, wherein said holding means carried by the plate means includes a plurality of threadedly inserted bolts establishing said insertions through the extensions.

6. The hybrid hull as defined in claim 3, wherein said holding means carried by the plate means includes a plurality of bolts threadedly extending through the extensions.

7. The hybrid hull as defined in claim 1, wherein said extensions include abutting portions in overlapping contact with each other to enhance said interconnection of the hulls sections.

8. The hybrid hull as defined in claim 1, wherein said holding means carried by the plate means includes adhesive through which said extensions are maintained in abutting contact with each other to enhance said interconnection of the hull sections.

9. The hybrid hull as defined in claim 1, wherein the structure of the midship section is metallic and is reinforced by cross-sectionally T-shaped ribs.

10. The hybrid hull as defined in claim 9, wherein the structure of the bow and stem hull sections is non-metallic and is reinforced by cross-sectionally hat-shaped ribs.

11. The hybrid hulls defined in claim 9, wherein the structure of the bow and stern hull sections is non-metallic and of sandwich construction.

12. The hybrid hull as defined in claim 1, wherein the structure of the midship section is of metallic double hull sandwich construction.

13. The hybrid hull as defined in claim 12, wherein the structure of the bow and stern sections are non-metallic and reinforced by cross-sectionally hat-shaped ribs.

14. The hybrid hull as defined in claim 12, wherein the structure of the bow and stern hull sections are non-metallic and of sandwich construction.

15. A hybrid hull of a marine vessel having a midship section from which bow and stern sections extend in opposite directions, wherein each of said hull sections has a reinforced structure with the structure of the midship section being made of a different material from that of the bow and stem sections, including: transition extensions between the hull sections establishing geometric compatibility therebetween and an arrangement for interconnection of the hull sections, comprising: plate means extending from the transition extensions; and holding means carried by said plate means for attaching the hulls sections to each other; said transition extensions establishing a flush cross-sectional relation between the structures of adjacent hull sections; said midship section being made of reinforced metal and the bow and stern sections being made of reinforced non-metallic material; said plate means including: inserts interfitted between the transition extensions and secured thereto by the holding means, said holding means carried by the plate means, including: a plurality of threadedly inserted bolts extending through the transition extensions, and collars in overlapping contact with the transition extensions through which the bolts extend.

16. The hybrid hull as defined in claim 15, wherein said plate means extends laterally from the collars in contact with the transition extensions of the bow and stern sections.

17. The hybrid hull as defined in claim 16, wherein said transition extensions of the midship section include hat-shaped portions abutting rib portions of the transition extensions of the bow and stem sections.

18. A hybrid hull of a marine vessel having a midship section from which bow and stern sections extend in opposite directions, wherein each of said hull sections has a reinforced structure with the structure of the midship section being made of a different material from that of the bow and stern sections, including: transition extensions between the hull sections establishing geometric compatibility therebetween and an arrangement for interconnection of the hull sections, comprising: plate means extending from the transition extensions; and holding means carried by said plate means for attaching the hulls sections to each other; said transition extensions establishing a flush cross-sectional relation between the structures of adjacent hull sections; said midship section being made of reinforced metal and the bow and stern sections being made of reinforced non-metallic material; said plate means including: inserts interfitted between the transition extensions and secured thereto by the holding means, said holding means carried by the plate means, including: a plurality of threadedly inserted bolts extending through the transition extensions, and collars in overlapping contact with the transition extensions through which the bolts extend.

19. The hybrid hull as defined in claim 18, wherein said plate means extends laterally from the collars in contact with the transition extensions of the bow and stern sections through which the bolts extend.

20. The hybrid hull as defined in claim 19, wherein the transition extensions of the midship hull section has hat-shaped portions which abut rib portions of the transition extensions of the bow and stem hull sections.

21. A hybrid hull of a marine vessel having a midship section from which bow and stem sections extend in opposite directions, wherein each of said hull sections has a reinforced structure with the structure of the midship section being made of a different material from that of the bow and stern sections, including: transition extensions between the hull sections establishing geometric compatibility therebetween and an arrangement for interconnection of the hull sections, comprising: plate means extending from the transition extensions; and holding means carried by said plate means for attaching the hulls sections to each other, the structure of the midship section being metallic and reinforced by cross-sectionally T-shaped ribs, the structure of the bow and stem hull sections being non-metallic and reinforced by cross-sectionally hat-shaped ribs, and the transition extensions of the midship section being the T-shaped ribs transitioned into hat-stiffened ribs to establish the geometric compatibility.

22. A hybrid hull of a marine vessel having a midship section from which bow and stem sections extend in opposite directions, wherein each of said hull sections has a reinforced structure with the structure of the midship section being made of a different material from that of the bow and stem sections, including: transition extensions between the hull sections establishing geometric compatibility therebetween and an arrangement for interconnection of the hull sections, comprising: plate means extending from the transition extensions; and holding means carried by said plate means for attaching the hull sections to each other, the structure of the midship section being metallic and reinforced by cross-sectionally the T-shaped ribs transitioned into hat-stiffened rib construction to form the transition extensions, while the bow and stem sections are of non-metallic sandwich construction transitioned by said hat-stiffened construction of the transition extensions to establish geometric compatibility.

23. A hybrid hull of a marine vessel having a midship section from which bow and stem sections extend in opposite directions, wherein each of said hull sections has a reinforced structure with the structure of the midship section being made of a different material from that of the bow and stem sections, including: transition extensions between the hull sections establishing geometric compatibility therebetween and an arrangement for interconnection of the hull sections, comprising: plate means extending from the transition extensions; and holding means carried by said plate means for attaching the hull sections to each other, the structure of the midship section being of metallic double hull sandwich construction, and the structure of the bow and stern sections is transitioned by hat-stiffened construction of the transition extensions to establish the geometric compatibility, while the structure of the bow and stern sections are non-metallic and reinforced by cross-sectionally hat-shaped ribs.

24. A hybrid hull of a marine vessel having a midship section from which bow and stern sections extend in opposite directions, wherein each of said hull sections has a reinforced structure with the structure of the midship section being made of a different material from that of the bow and stern sections, including: transition extensions between the hull sections establishing geometric compatibility therebetween and an arrangement for interconnection of the hull sections, comprising: plate means extending from the transition extensions; and holding means carried by said plate means for attaching the hull sections to each other, the structure of the midship section being of metallic double hull sandwich construction transitioned by hat-stiffened construction of the transition extensions, while the bow and stern sections are of non-metallic sandwich construction transitioned by hat-stiffened construction of the transition extensions to establish the geometric compatibility.

* * * * *